US005080161A

United States Patent [19]

Horie et al.

[11] Patent Number: 5,080,161

[45] Date of Patent: Jan. 14, 1992

[54] SYSTEM FOR PREPARING SELF-HARDENING CASTING MOLD USING ORGANIC BINDER

[75] Inventors: Takao Horie, Gifu; Shoichi Sakai, Kakamigahara, both of Japan

[73] Assignee: Okamoto Co., Ltd., Japan

[21] Appl. No.: 609,653

[22] Filed: Nov. 6, 1990

[30] Foreign Application Priority Data

May 2, 1989 [JP] Japan ..... 1-113037
Jun. 27, 1990 [JP] Japan ..... 2-169165

[51] Int. Cl.[5] ..... B22C 9/12

[52] U.S. Cl. ..... 164/269; 164/412; 164/521; 164/5

[58] Field of Search ..... 164/269, 412, 16, 521, 164/5

[56] References Cited

FOREIGN PATENT DOCUMENTS 2-220730 9/1990 Japan .

*Primary Examiner*—Kuang Y. Lin

*Attorney, Agent, or Firm*—Parkhurst, Wendel & Rossi

[57] ABSTRACT

A system for preparing a self-hardening casting mold including a mass of sand which contains an organic binder and which has a pattern-contact layer having a surface for contact with a pattern disposed in a flask. The pattern defines a cavity into which a melt is poured to produce a cast product. The mold further includes a mass of ceramic balls placed on the pattern-contact layer of the sand mass. The system includes a temperature adjusting device for regulating the temperature of the mass of ceramic balls prior to introduction thereof into the flask, so as to control the hardening rate of mass of sand in the flask, a separating device operable on a mixture of sand and ceramic balls obtained from the mold after the cast product is produced by the mold with the pattern removed. The separating device separates the ceramic ball from the sand, and supplies the ceramic balls to the temperature adjusting device. The system further includes a sand reclaiming device for treating the separated sand to be reclaimed for preparing another casting mold.

12 Claims, 4 Drawing Sheets

SYSTEM FOR PREPARING SELF-HARDENING CASTING MOLD USING ORGANIC BINDER

BACKGROUND OF THE INVENTION

1. Field of the Invention

The present invention relates in general to a system or line adapted to prepare a casting mold using a self-hardening sand mixture containing an organic binder, and more particularly to an improved mold preparation system capable of suitably controlling the rate of hardening of the self-hardening sand mixture.

2. Discussion of the Prior Art

A self-hardening casting mold using an organic binder for hardening the molding sand has been widely used for casting medium- and large-sized articles weighing 50Kg or more, such as cast iron parts of machine tools. The use of such an organic binder permits the patterned sand mass to be hardened into a desired mold, without applying heat thereto, and this mold preparation process is sometimes referred to as "no-bake" method. Usually, a furan resin (thermosetting polymer made from furfuryl alcohol) is used as the organic binder mixed in the sand. An acidic hardening catalyst (hardening agent) is generally added to a liquid condensation product resin having a relatively small molecular weight, to initiate a condensation reaction for progressively increasing the activity of the resin, and eventually maximizing the binding force by three-dimensional cross linking, so that the molding sand is firmly packed as a casting mold. In producing a cast article by using such a self-hardening mold, a suitably prepared molten metal is poured into the mold. After the molten metal in the mold is solidified, the mold is opened or broken to remove the casting, and the sand remaining on the casting is removed. The sand of the broken mold is subjected to a reclaiming process in which cast iron fins, flashes or particles or other undesired metallic inclusions are magnetically separated from the sand.

The casting by a self-hardening mold using an organic binder as indicated above has the following advantages: (a) reduced number of steps required for preparing the mold, due to elimination of baking or heating of the sand because of complete hardening at the room temperature of the sand mixture containing an organic binder; (b) relatively high strength of the mold, and improved dimensional accuracy of the cast article obtained from the mold; (c) reduced amount of silica sand required, and reduced environmental pollution due to the waste products in the casting operation; and (d) relatively easy breakage of the sand mold after removal of the cast article, and as high as 90–95% reclaiming of the sand for repetitive mold preparation and casting cycles. For these advantages, the self-hardening casting mold is presently used in many foundries, for casting a wide variety of components for industrial machines and machine tools.

While the self-hardening casting mold has such advantages as described above, the cost of manufacture tends to be high, due to the use of an organic binder resin and a hardening agent, which are comparatively expensive. Various solutions to this problem have been proposed so far. In this connection, it is noted that where the cast products are components such as machine tool parts which are produced in a relatively small lot size, the sand-metal ratio S/M (S and M respectively representing the weights of the sand and metal materials used for preparing the cast product) tends to be relatively high, thereby increasing the cost of the cast products obtained by the prepared mold, since a relatively large volume of sand should be packed in a relatively large metal flask or molding box, in not a few cases. Namely, the use of metal flasks exclusively designed for respective small lots of cast products is not economical, and requires a large storage space. Therefore, the same metal flask should generally be used for the cast products having different sizes. If the flask designed for a large cast products is used for producing a small cast product, the volume of the sand that should be packed in the flask to prepare a casting mold for that cast product is inevitably larger than is actually required.

To lower the sand/metal (S/M) ratio in preparing the casting mold, it is proposed to reduce the amount of the casting sand, by using a mass of ceramic balls or other material which replaces a portion of the sand mass which should fill the appropriate parts of the interior of a metal flask or molding box. Namely, the mass of the ceramic balls or similar material is embedded in the surrounding mass of the sand providing a mold surface which contacts the melt to be poured in the prepared mold and which defines a mold cavity corresponding to the cast product to be produced by the mold.

In the self-hardening casting mold as described above, the strength of the mold structure depends upon the binding force produced by a three-dimensional cross linking phenomenon which occurs as a result of the condensation reaction of an organic binder and a hardening agent which are added to the sand. Since the rate of the condensation reaction is greatly influenced by the temperature of the sand mass, the rate of hardening of the mold sand and the time required to complete the desired casting mold from the sand mass considerably vary with a change in the ambient temperature at the time of preparing the mold.

In fact, it is difficult to hold the ambient temperature within a foundry at a constant level year round, for maintaining the metal flasks and patterns at a constant temperature. There may be a temperature difference of 30° or more between the summer and winter seasons. In a casting operation for producing castings in a relatively small lot size using different flasks and patterns for respective different molds (for different castings to be produced), the temperatures of the flasks and patterns are held relatively constant. However, the temperatures of the flask and pattern tend to gradually increase in a casting operation in a medium lot size, in which the same flask and pattern are repeatedly used for producing different molds for different castings, at relatively short time intervals, with the flasks and patterns being removed from the prepared mold for preparation of the next mold. Thus, the hardening time of the sand mold fluctuates, causing a time schedule in a series of casting operation which includes the preparation of the mold and the pouring of the melt in the prepared mold.

It is therefore necessary to minimize the fluctuation of the required hardening time of the casting mold. On the other hand, the hardening time of the molds should be controlled to meet the requirements in the actual casting operation, such as the required number of cast products per day, and the required delivery of the products. Conventionally, different hardening agents (e.g., mixtures of sulfonic acids and additives) are selectively used and the amount of the selected hardening agent is determined, depending upon the required hardening time.

Suppose a casting mold is sufficiently hardened in about 10–15 minutes in the summer time, but in more than 20 minutes in the winter time, if the pattern, metal flask, the size of the flask, the temperature's of the pattern, flask and sand, the organic binder and the hardening agents are the same in the summer and winter times. In this case, the hardening time in the winter time may be made almost equal to that in the summer time, by increasing the amount of the hardening agent, or using the hardening agent different from that in the summer time if the increase in the amount of the same hardening agent does not attain the desired result.

However, the above conventional method using the different hardening agents is complicated in controlling the hardening time and is difficult to be practiced to achieve the desired result. Further, if an inadequate hardening agent is erroneously used, the entire casing process including the preparation of a casing mold gets out of order. The use of many kinds of hardening agents requires respective storage reservoirs that should be maintained for immediate use. Where a casing mold to be prepared has a large size, it takes as along as 10 minutes or so to pack the sand in the flask, since the surface layer of the sane contacting the pattern should be evenly formed. Moreover, the hardening of the sand may start during the packing of the sand, in the hardening agent is added in a large amount. In this case, the mold preparation efficiency and the quality of the prepared mold are not satisfactory.

If the hardening time of the sand is controlled by regulating the temperatures of the sand, pattern and flask are controlled by application of heat thereto, a relatively large heating device is required, and the sand is heated from the very beginning of the packing in the flask, causing undesired early commencement of hardening of the sand. In this sense, this procedure is not practically available.

SUMMARY OF THE INVENTION

It is therefore an object of the present invention to provide a system for preparing a self-hardening casting mold using an organic binder, wherein the rate of hardening of the mold sand by the binder can be easily and stably controlled to an optimum level.

The above object may be achieved according to the principle of the present invention, which provides a system for preparing a self-hardening casting mold including a mass of sand which contains an organic binder and which comprises a pattern-contact layer having a surface for contact with a pattern disposed in a flask, the casting mold further including a mass of ceramic balls placed on the pattern-contact layer of the sand mass, the pattern defining a cavity into which a melt is poured to produce a cast product, the system comprising: (a) a temperature adjusting device for regulating a temperature of the mass of ceramic balls prior to introduction of the ceramic balls into the flask, so as to control a rate of hardening of the mass of sand in the flask; (b) a separating device operable on a mixture of sand and ceramic balls obtained from the casting mold after the cast product is produced by the casting mold with the pattern removed, the separating device separating the ceramic ball from the sand, and supplying the ceramic balls to the temperature adjusting device; and (c) a sand reclaiming device for treating the sand separated from the ceramic balls, to be reclaimed for preparing another casting mold.

In the mold preparing system of the present invention constructed as described above, the rate of hardening of the casting mold is controlled by regulating the amount of heat applied to the ceramic balls to be introduced into the flask to constitute a part of the mold, rather than by selecting one of a plurality of different hardening agents or adjusting the amount of the selected hardening agent. According to the present system, the hardening time of the casting mold can be easily and stably controlled by simply adjusting the temperature of the mass of ceramic balls.

Thus, the present mold preparing system is capable of avoiding an undesirable increase in the hardening time of the mold in the winter time, and is free from the conventionally encountered fluctuation in the hardening time which occurs at the varying temperature conditions. The present system therefore permits a series of casting operations for improved stability of quality of the prepared molds and cast products produced by the molds. Further, the system is easy to maintain and economical to operate, since the system can be operated with a single kind of hardening agent, which does not require an ample storage space as required in the conventional system.

BRIEF DESCRIPTION OF THE DRAWINGS

The above and other objects, features and advantages of the present invention will be better understood by reading the following detailed description of a presently preferred embodiment of the invention, when considered in connection with the accompanying drawings, in which.

DETAILED DESCRIPTION OF THE PREFERRED EMBODIMENT

Figure 1:
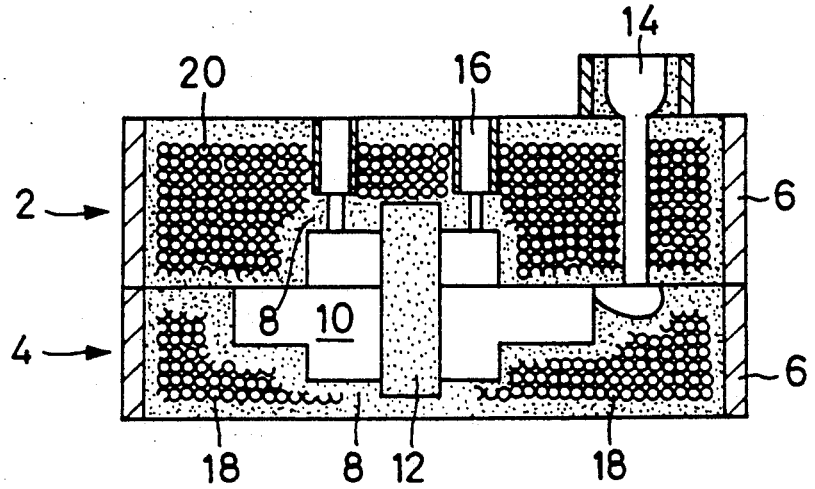
FIG. 1 is an elevational view in longitudinal cross section of an example of a self-hardening casting mold prepared by a mold preparation system according to the principle of the present invention.

Referring first to FIG. 1, a self-hardening casting mold is shown by way of example, as accommodated in a flask or molding box 6 consisting of an upper and a lower half. The casting mold consists of an upper mold half 2 and a lower mold half 4 which cooperate with each other to define a mold cavity 10. This cavity 10 is defined by a corresponding pattern (not shown) disposed in the flask 6. The casting mold 2, 4 includes a mass of sand 8 and a mass of refractory ceramic balls 18, which are packed so as to fill a space defined by and between the flask 6 and the pattern corresponding to the cavity 10. The mass of ceramic balls 18 is embedded in the sand mass 8, which consists of a pattern-contact layer contacting the pattern, a flask-contact layer contacting the flask 6, and backing layers cooperating with the pattern-contact and flask-contact layers to surround the mass of ceramic balls 18. The use of the ceramic balls 18 reduces the volume of the sand 8 required to form the mold 2, 4, and contributes to an increase in the rate of hardening of the mold and a decrease in the cost of manufacture:. Reference numerals 12, 14 and 16 denote a core, a pouring gate or basin, and a riser, respectively. The core 12 is also a compacted mass of sand, which is positioned in the prepared mold 2, 4, with the upper and lower mold halves 2, 4 once separated from each other.

The casting mold 2, 4 can be suitably prepared according to the principle of the present invention, which requires adjustment of the temperature of the ceramic balls 18 by heating or cooling thereof prior to the introduction into the flask 6.

Figure 2:
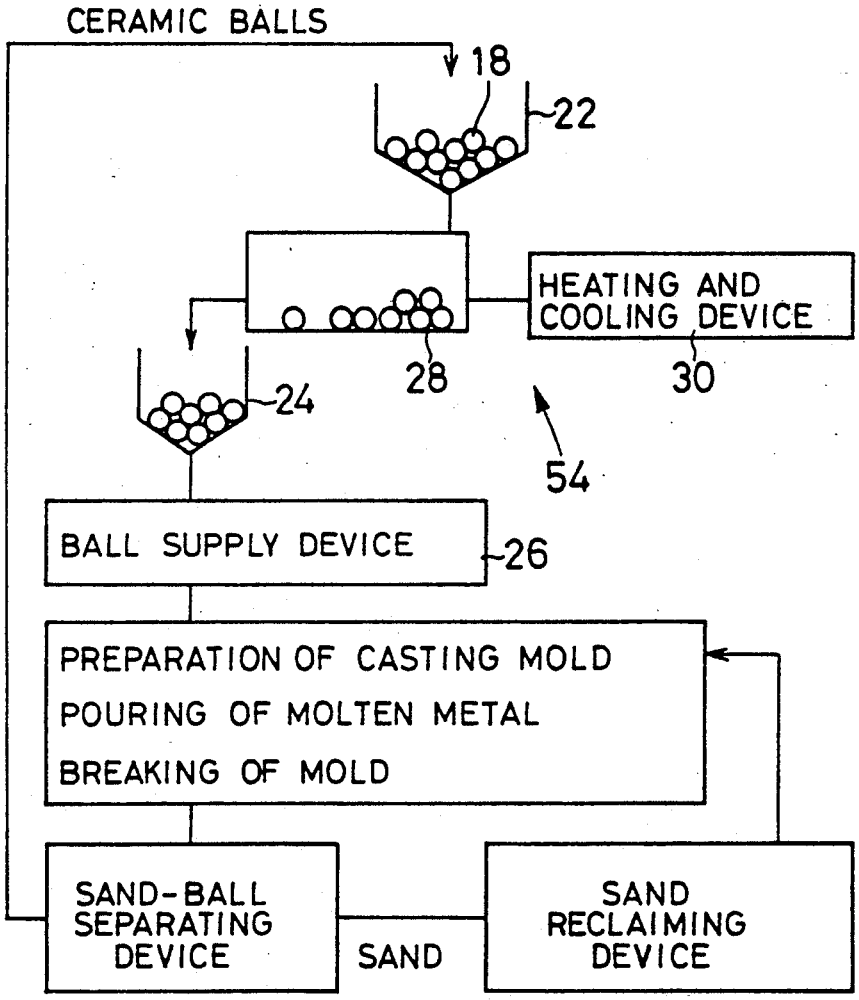
FIG. 2 is a view illustrating the basic arrangement of one embodiment of the mold preparation system of the present invention.

Referring next to FIG. 2, there will be described a basic arrangement of a mold preparing system adapted to prepare a self-hardening mold by using an organic binder. The system includes a temperature adjusting device for regulating the temperature of the ceramic balls 18, a sand-ball separating device which acts on a mixture of sand and ceramic balls obtained from the casting mold after the production of a cast product by the mold with the pattern removed, for separating the ceramic balls from the sand, and a sand reclaiming device for treating the separated sand to be reclaimed for preparing another casting mold. The ceramic balls separated from the sand by the sand-ball separating device are transferred to the temperature adjusting device, so that they are reserved at a predetermined optimum temperature, to be used for preparing casting molds in subsequent mold preparation cycles.

Described more specifically, the ceramic balls 18 separated from the sand are once stored in a recovery hopper 22, at which the temperature of the ceramic balls 18 is measured by a suitable temperature sensor. This sensor constitutes a part of the above-indicated temperature adjusting device shown at 54 in FIG. 2. The temperature adjusting device 54 includes a revolving drum 28, and a heating and cooling device 30 adapted to regulate the temperature within the revolving drum 28. A mass of the ceramic balls 18 whose temperature has been measured at the recovery hopper 22 is introduced into the revolving drum 28, so that the balls 18 are heated or cooled to the predetermined temperature, by suitable heating or cooling means of the heating and cooling device 30. The heating means may be a burner for introducing a stream of hot air into the drum 28, and the cooling means may be a fan or blower for introducing a stream of cool air into the drum 28. After the temperature of the ceramic balls 18 is adjusted within the revolving drum 28, the balls 18 are fed into a storage hopper 24, and then into a ball supply device 26 from which the balls 18 are introduced into the flask 6. The heating means of the heating and cooling device 30 may utilize residual heat of the sand 8 separated from the balls 18 by the sand-ball separating device. The operating conditions of the temperature adjusting device 54, such as the preset temperatures of the hot and cool air streams introduced into the drum 28, and the rotating speed of the drum 28, are determined by the temperature of the balls 18 as measured at the storage hopper 22, the amount of the balls 18, and other parameters (e.g., the drum rotating speed being determined by the preset temperatures of the device 30).

Figure 3:
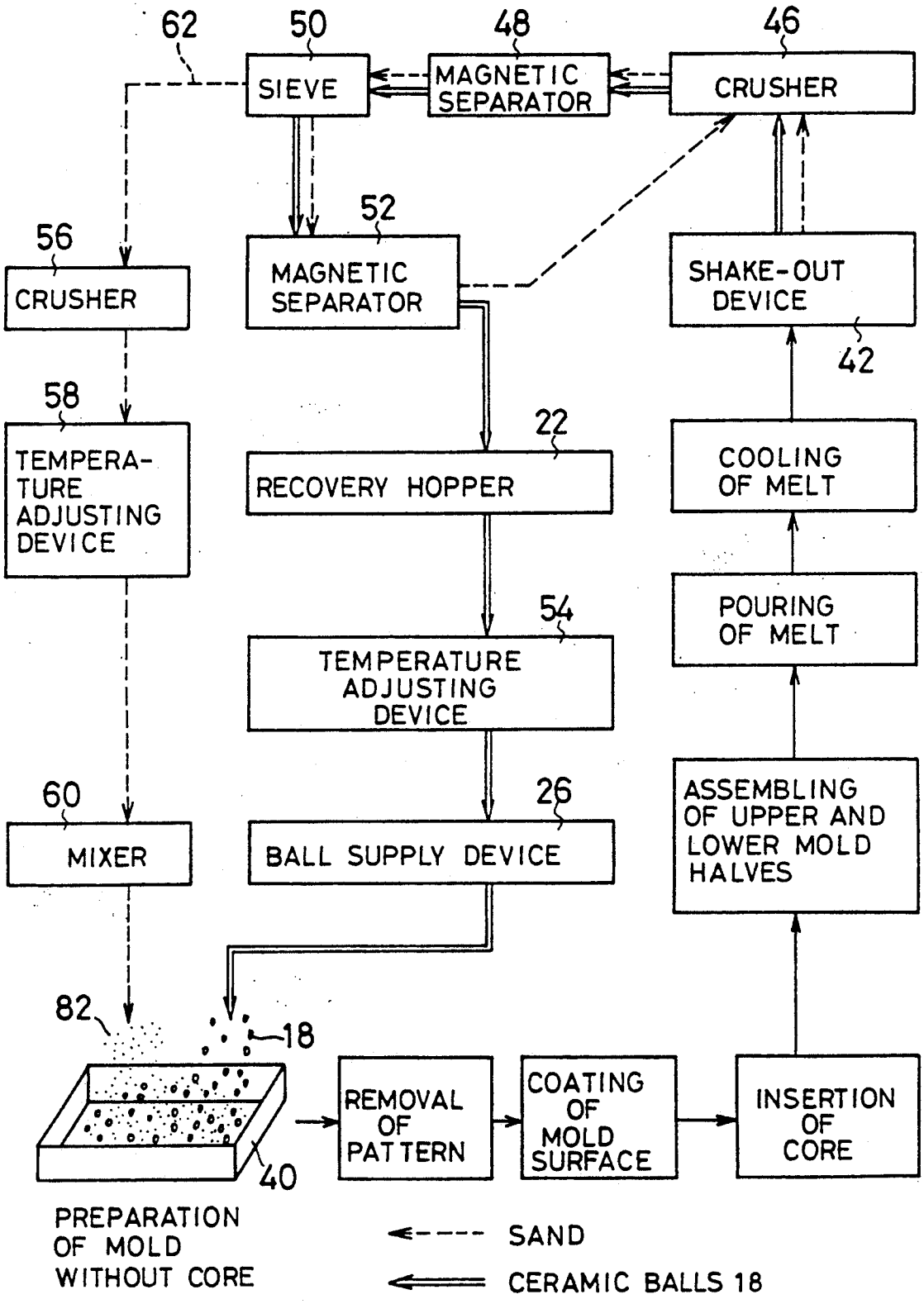
FIG. 3 is a view illustrating in detail the mold preparation system of FIG. 2.

Referring further to FIG. 3, the mold preparing system will be described in greater detail.

In FIG. 3, reference numeral 40 designates an initially prepared casting mold 2, 4 prepared without the core 12 received therein. This casing mold 40 is coated with a suitable material at the surface defining the cavity 10, after the pattern defining the cavity 10 is removed from the mold 40. Then, the core 12 is disposed in predetermined positional relationship with the cavity 10 in the mold 40, while the upper and lower mold halves 2, 4 are separated from each other. The two mold halves 2, 4 are then assembled together into the desired casting mold used for producing a cast product corresponding to the cavity 10. In a casting operation, a molten metal is poured into the cavity 10 through the pouring gate 14, and the melt is cooled and solidified into the desired cast product. Thus, the casting operation is performed in the manner well known in the art. The flask 6 is then removed from the mold, and the used mold is broken open by a shake-out device 42, to remove the cast product. The broken mold is crushed by a crusher 46, into fragments of the sand 8 and the ceramic balls 18, and the mixture of the sand fragments 8 and the ceramic balls 18 is passed through a magnetic separator 48, so that iron fins, flashes and other inclusions are separated from the mixture of sand and ceramic balls 8, 18. Then, the mixture is fed into the sand-ball separating device 50, 52 which includes a sieve 50 and a magnetic separator 52.

The sieve 50 has a perforated filtering member through which relatively finely divided fragments or particles 62 of the sand 8 of the mixture 8, 18 is passed to the sand reclaiming device which includes a crusher 56. Thus, the sand particles 62 are separated from the ceramic balls 18 by the sieve 50. On the other hand, the ceramic balls 18 and the relatively large fragments of the sand 8 are transferred to the magnetic separator 52, which separate the ceramic balls 18 from the sand fragments, so that the ceramic balls 18 are fed to the temperature adjusting device 54 via the recovery hopper 22. The relatively large fragments of the sand 8 are transferred from the magnetic separator 52 back to the crusher 46, for further crushing of the fragments. Thus, the sand-ball separating device 50, 52 operates to feed the relatively fine fragments or particles 62 of the sand 8 to the crusher 56 of the sand reclaiming device, return the relatively large sand fragments 8 back to the crusher 46, and transfer the ceramic balls 18 to the recovery hopper 22.

The ceramic balls 18 are formed of a ceramic material mixed with a magnetic material, as disclosed in laid-open Publication No. 2-220730 (published Sept. 3, 1990) of unexamined Japanese Patent Application. The magnetic separator 52 is adapted to separate the ceramic balls 18 from the sand fragments 8, by utilizing a magnetic attractive force acting on the ceramic balls 18 containing the magnetic material.

Figure 4:
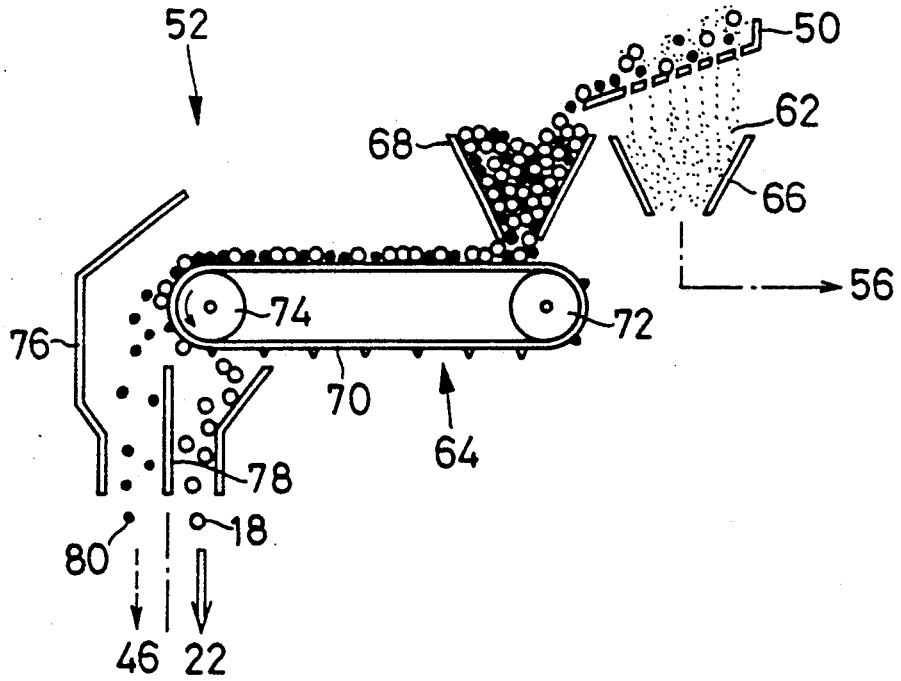
FIG. 4 is a schematic view showing an example of a ball-sand separator used in the system of FIGS. 3 and 4, for separating ceramic balls and sand to be reclaimed.

An example of the magnetic separator 52 is shown in FIG. 4. The magnetic separator 52 as shown includes a belt conveyor 64 having an endless belt 70 which rotates on a drive pulley 72 and a driven magnet pulley 74, and a separating section 76 disposed adjacent to the magnet pulley 74. While the relatively finely divided particles 62 of the sand 8 is passed through the sieve 50 into a receiver 66 and fed to the crusher 56 as described above, the mixture of the ceramic balls 18 and the relatively large sand fragments 8 is transferred from the sieve 50 into a hopper 68 of the sand-ball separating device 52. The hopper 68 is located above one end portion of the span of the belt 70 of the belt conveyer 64 on the side of the drive pulley 72, so that the mixture of the balls 18 and sand fragments 8 is delivered onto the belt 70. With the belt 70 rotated in the counterclockwise direction as seen in FIG. 4, the mixture reaches the upper opening of the separating section 76, in which the magnet pulley 74 is disposed. Since only the ceramic balls 18 are magnetically attracted toward the magnet pulley 74, only the sand fragments fall from the end of the span of the belt 70 on the side of the magnet pulley 74, as indicated at 80 in FIG. 4, while the ceramic balls 18 continue to be moved by the belt 70 until they reach a position slightly ahead of the position right under the magnet pulley 74 in the direction of movement of the belt 70. The ceramic balls 18 fall from under the magnet pulley 74, in the absence of the magnetic attractive force acting on the balls. Thus, the relatively large sand fragments 80 and the ceramic balls 18 are separated such that the sand fragments 80 are fed to the crusher 46 through a path on one side of a separator plate 78 disposed in the separating section 76, while the ceramic balls 18 are fed into the hopper 22 through another path or the other side of the separator plate 78.

The ceramic balls 18 are transferred from the hopper 22 to the temperature adjusting device 54, and the temperature-controlled balls 28 are fed to the ball supply device 26 via the hopper 24, as indicated in FIG. 2. The relatively large sand fragments 80 are finely divided by the crusher 46, so that the finely divided sand particle 62 is passed through the sieve 50 and fed to the crusher 56 via the receiver 66.

The finely divided sand particles 62 is further refined by the crusher 56, and then cooled as needed by a temperature adjusting device 58. The particles 62 is subsequently fed into a mixer 60, so that a suitable hardening agent and a suitable organic binder such as a resin are added to the particles 62, so as to provide reclaimed sand 82 to be used for preparing another casting mold.

The temperature range of the ceramic balls 18 is determined by the temperatures of the sand 8 (82), pattern and flask 6, and by the overall casting cycle time (including the mold preparation time). If for example the temperatures of the sand 8, pattern and flask 6 are relatively low and the casting cycle time is relatively short, the temperature adjusting device 54 is operated to maintain the reclaimed ceramic balls 18 at a relatively high temperature around 100° C. If the temperatures are relatively high and the overall cycle time is relatively long, the ceramic balls 18 are held at a relatively low temperature around 50° C.

Figure 5:
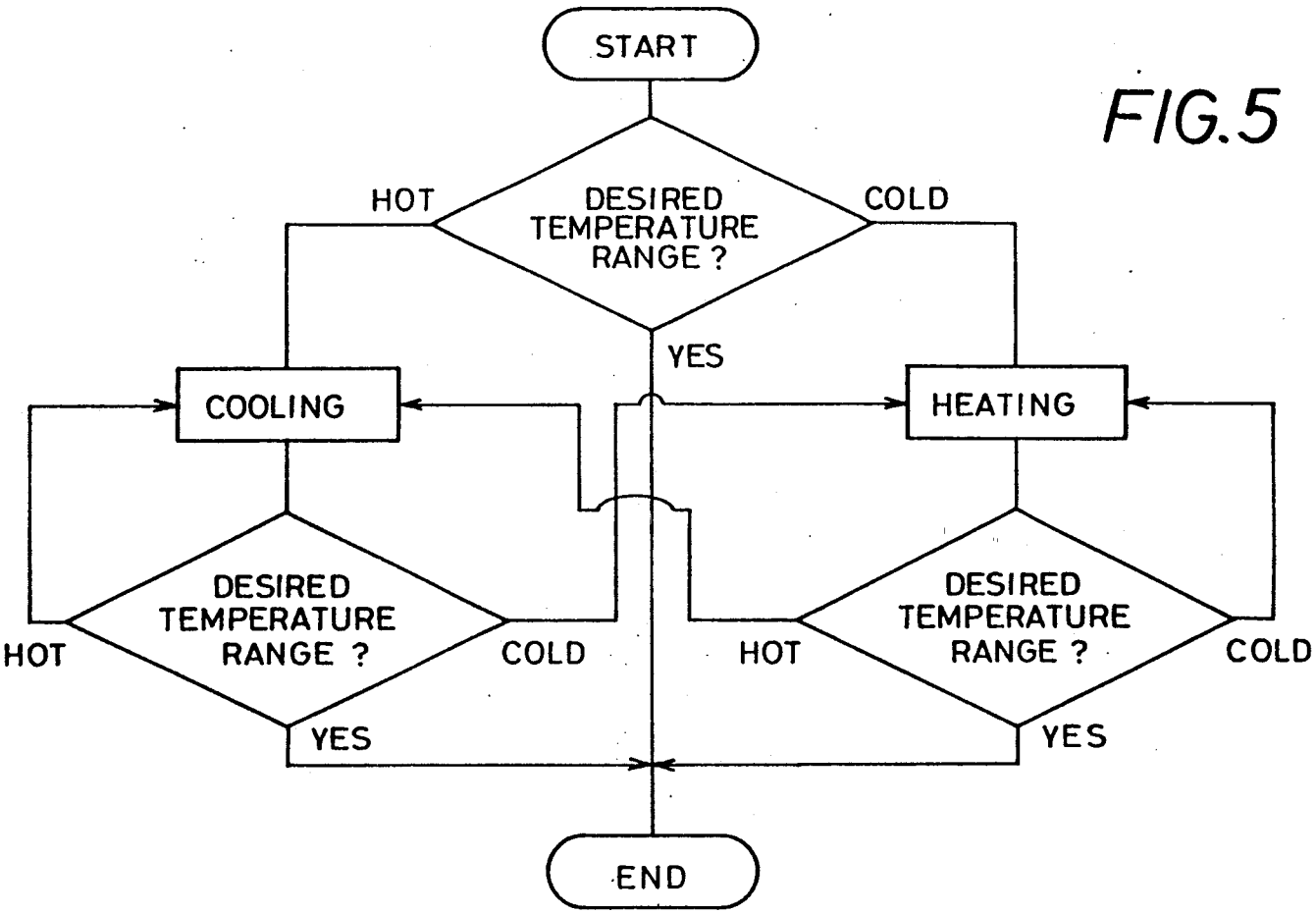
FIG. 5 is a flow chart illustrating a procedure for adjusting the temperature of the ceramic balls in the mold preparation system.

With the desired temperature range of the ceramic balls 18 is preset, the temperature adjusting device 54 is operated to regulate the temperature of the ceramic balls 18, as indicated in the flow chart of FIG. 5. Usually, the temperature of the ceramic balls 18 as measured at the recovery hopper 22 ranges from the ambient temperature to 200° C., which varies depending upon the operating conditions of the mold preparation and casting system. If the measured temperature of the ceramic balls 18 is higher than the upper limit of the preset temperature range, the temperature adjusting is operated to cool the ceramic balls 18 in the revolving drum 28. If the measured temperature is lower than the lower limit of the preset range, the balls 18 are heated. The temperature of the cooled or heated balls 18 is compared with the upper and lower limits of the preset range, so that the temperature adjusting device 54 is operated until the temperature of the balls 18 falls within the preset range.

Generally, the temperature of the reclaimed ceramic balls 18 is regulated within a range between 30° C. and 100° C. Although the size and shape of the ceramic balls 18 are not particularly limited, the balls 18 preferably have a diameter selected within a range of 20–40mm, to provide a relatively large mass for storing thermal energy. Obviously, the balls 18 may have different sizes.

In the illustrated embodiment, the temperature adjusting device 54 is adapted to heat or cool the ceramic balls 18 while they are accommodated in a batch in the drum 28. This batch treatment arrangement is desirable for its high storage capacity, where the casting molds are used for producing large castings and require the ceramic balls 18 in a large amount. Where the system is adapted to produce relatively small castings with a relatively short cycle time, it is desirable that the ceramic balls 18 be treated for temperature regulation while they are transferred from the sand-ball separating device to the ball supply device 26. In this latter case, the heating and cooling device 30 may be connected to a suitable conduit connecting the hopper 22 and the ball supply device 26, for example, so that the ceramic balls 18 which are moved by a screw type conveyor received in the conduit are heated or cooled. Either the former arrangement or the latter arrangement is selected depending upon the castings to be produced, size of the casting molds used, mold preparation and casting cycle time, and other parameters.

The reclaimed ceramic balls 18 whose temperature is regulated as described above are introduced into the flask 6, after the pattern-contact layer of the sand mass 8 is initially formed so as to surround the pattern disposed in the flask 6. The sand mass 8 is a conventionally used mixture of sand, an organic binder such as furan resin, phenolic resin and acrylic resin, and a hardening agent for curing such binder resin. According to the present invention, however, the amount of the hardening agent is reduced as compared with that used in the conventional system, since the rate of hardening of the sand is controlled by the heat of the ceramic balls 18. Consequently, the pattern-contact layer of the sand mass 8 (reclaimed sand 82) contacting the pattern is prevented from starting the hardening during packing of the said around the pattern. After the pattern-contact layer of the sand mass 8 is formed around the pattern, a suitable volume of the temperature-controlled ceramic balls 18 is introduced onto the pattern-contact sand layer, whereby the hardening of the pattern-contact sand layer is immediately initiated, irrespective of the ambient temperature and the temperatures of the pattern and flask 6. After the introduction of the ceramic balls 18, a backing layer of the sand mass 8 is formed as needed, so as to embed the mass of the ceramic balls 18 in the mass of the sand 8. This backing sand layer reinforces the casting mold prepared.

For improvement in the density of the sand and ceramic balls, that the flask 6 is filled with the sand 8 and the ceramic balls 18 while vibrations are applied to the introduced masses of the sand and ceramic balls. While the volumetric ratio of the sand to the ceramic balls depends upon the shape, size and weight of the cast product and the construction of the flask, about 30-40% by volume of the interior space in the flask may be occupied by the ceramic balls, without significantly lowering the strength of the mold prepared.

After the interior space of the flask 6 is filled with the sand and ceramic balls, a suitable time is allowed to permit the surface portion of the prepared mold to be hardened. Then, the pattern is removed. Since the hardening time of the mold can be easily controlled by regulating the temperature of the ceramic balls, the mold can be hardened in a desired time even in the winter time, without a fluctuation under the varying environmental temperature condition. The removed pattern is used, together with the flask, in the next mold preparation cycle. On the other hand, the prepared casting mold is subjected to a surface coating operation, after the condensation reaction of the organic binder is completed throughout the mold mass. To facilitate the condensation reaction, the removal of the pattern may be delayed to facilitate the transfer of heat to the central portion of the mold mass. This may reduces the time from the beginning of the mold preparation up to the assembling of the upper and lower mold halves (after the mold surface coating, positioning of the core 12).

With the mold completely hardened, the mold surface is coated with a suitable material well known in the art, and the core 12 is positioned and the upper and lower mold halves are assembled together. Then, a molten metal such as a cast iron melt or steel melt is poured into the mold cavity, and the melt is cooled into a desired product. The flask 6 is then removed from the mold, and the mold is broken open to remove the obtained cast product. The removed cast product is cleaned by a shot blast, and is subjected to an operation to remove the fins or flashes remaining on the surface of the product. The broken mold is crushed, and the inclusions such as the metal flashes or particles are magnetically removed from the mixture of the sand and ceramic balls, by the magnetic separator 48, in the manner known in the art. The ceramic balls are separated from the sand by the separating device 50, 52, so that the sand is processed to be reclaimed, while the ceramic balls are temperature-controlled by the temperature adjusting device 54.

While the magnetic separator 52 having the magnet pulley 74 is used to separate the refractory ceramic balls from the sand, by utilizing the magnetic property of the balls, the magnetic separator 48 may be modified to separate the ceramic balls as well as the metallic inclusions, from the sand material. In this case, the magnetic force produced by the magnetic separator 48 is changed in two steps, one for separating the inclusions and the other for separating the ceramic balls.

The ceramic balls which contain a magnetic material as indicated above have high degrees of strength and thermal and wear resistances sufficient to withstand thermal shocks during a casting operation. Further, the ceramic balls are light-weighted and easy to be introduced into the flask, and function as means for storing thermal energy for effectively and suitably controlling the rate of hardening of the sand mass during preparation of the mold according to the principle of the present invention. After the prepared mold is broken and crushed after the use for a casting operation, the ceramic balls may be easily magnetically separated from the sand and the inclusions, by the magnetic separators 48, 52.

EXAMPLE

To further illustrate the principle of the present invention, there was prepared a casting mold as shown in FIG. 1 for casting a gear blank, according to a mold preparation and casting system as illustrated in FIGS. 2 and 3. The specifications of the gear blank, flask and pattern, and the mold composition are indicated below.

| | |
|---|---|
| (1) Gear blank | |
| Outside diameter | 1200 mm |
| Height (Axial length) | 50 mm (min.)<br>120 mm (max.) |
| Weight | 550 kg |
| Material | FC30 (JIS) |
| (2) Flask | |
| Upper half (W × L × H) | 1600 × 1800 × 300 mm |
| Lower half (W × L × H) | 1600 × 1800 × 250 mm |
| (3) Pattern | |
| Corresponding to the gear blank | |
| (4) Mold | |
| Sand | AFS40 (JIS) |
| Organic binder | Furan resin (0.8 wt. % with respect to the sand) |
| Hardening agent | 24 wt. % with respect to the binder |
| Ceramic balls | Cordierite ($2MgO.2Al_2O_3.5SiO_4$) |
| Diameter | 25 mm |
| Magnetic core | Ni—Zn ferrite (diameter: 10 mm) |

A plurality of specimens of the casting mold were prepared under the same conditions, i.e., at the ambient temperature of 4° C., with the sand and ceramic balls held at 10° C. and 90° C., respectively. The sand-metal ratio (S/M) of the mold was 1.63.

All the prepared specimens were hardened in about 10–15 minutes. That is, the pattern could be removed to obtain the desired casting mold 10–15 minutes after the interior space of the flask was filled.

As a comparative example, a plurality of similar casting mold specimens were prepared using the same flask and pattern as specified above, at the room temperature of 4° C., with the AFS40 sand held at 10° C. As in the example according to the invention, 0.8 wt.% of furan resin was added to the sand for each comparative specimen. However, no ceramic balls were used, and different amounts of the hardening agent were added to the sand masses for the respective comparative specimens. To harden the comparative specimen molds in about 10–15 minutes, the required amount of the hardening agent was as high as 38 wt.% with respect to the furan resin (organic binder).

It will be understood from the above description of the example according to the present invention as compared with the comparative example, that the rate of hardening of the mold prepared according to the present invention can be suitably controlled, without changing the amount of the hardening agent, by regulating the thermal energy stored in the ceramic balls, whose temperature is controlled prior to the introduction into the flask. Namely, the casting mold prepared according to the invention can be hardened in a desired time with a relatively small amount of hardening agent added to the sand mass.

While the present invention has been described in its presently preferred embodiment by reference to the accompanying drawings, it is to be understood that the invention is not limited to the details of the illustrated embodiment, and that the invention may be embodied with various changes, modifications and improvements, which may occur to those skilled in the art, without departing from the spirit and scope of the invention defined in the following claims.

What is claimed is:

1. A system for preparing a self-hardening casting mold including a mass of sand which contains an organic binder and which comprises a pattern-contact layer having a surface for contact with a pattern disposed in a flask, said casting mold further including a mass of ceramic balls placed on said pattern-contact layer of said sand mass, said pattern defining a cavity into which a melt is poured to produce a cast product, said system comprising:

a temperature adjusting device for regulating a temperature of said mass of ceramic balls prior to introduction of said ceramic balls into said flask, so as to control a rate of hardening of said mass of sand in said flask;

a separating device operable on a mixture of sand and ceramic balls obtained from said casting mold after said cast product is produced by the casting mold with said pattern removed, said separating device separating said ceramic ball from said sand, and supplying said ceramic balls to said temperature adjusting device; and a sand reclaiming device for treating the sand separated from said ceramic balls, to be reclaimed for preparing another casting mold.

2. A system according to claim 1, wherein said separating device includes a sieve for separating relatively finely divided particles of the sand from relatively large fragments of the sand and said ceramic balls.

3. A system according to claim 2, wherein said separating device further includes a magnetic separator for magnetically separating said ceramic balls from said relatively large fragments of the sand.

4. A system according to claim 3, further comprising a crusher for crushing said casting mold, to obtain said mixture of sand and ceramic balls, and wherein said separating device further includes means for transferring said relatively large fragments of the sand to said crusher for crushing said relatively large fragments of the sand.

5. A system according to claim 1, wherein said separating device includes a magnetic separator for magnetically separating said ceramic balls from said sand.

6. A system according to claim 5, wherein each of said ceramic balls contains a magnetic material.

7. A system according to claim 6, wherein said magnetic separator comprises a belt conveyor including an endless belt for receiving said mixture of sand and ceramic balls, and a pair of pulleys connected by said belt for rotating said belt, one of said pulleys including a magnet for magnetically attracting said ceramic balls when said ceramic balls are moved adjacent to said one pulley by said belt.

8. A system according to claim 1, wherein said temperature adjusting device includes a heating and cooling device having heating means and cooling means for controlling the temperature of said ceramic balls separated from said sand by said separating device.

9. A system according to claim 8, wherein said temperature adjusting device further includes a revolving drum which receives said ceramic balls separated from said sand by said separating device, said heating and cooling device being connected to said drum such that a temperature within an interior of said drum is controlled by said heating and cooling device.

10. A system according to claim 8, further comprising a temperature sensor for measuring the temperature of said ceramic balls separated from said sand by said separating device, said heating and cooling device being operated according to an output signal of said temperature sensor.

11. A system according to claim 8, wherein said heating and cooling device is operated so that the temperature of said ceramic balls is held within a range of 30–100° C.

12. A system according to claim 1, wherein each of said ceramic balls has a diameter of about 20–40mm.

* * * * *